US006278098B1

(12) United States Patent
Han et al.

(10) Patent No.: US 6,278,098 B1
(45) Date of Patent: Aug. 21, 2001

(54) MICROWAVE OVEN WITH A COOKING COMPARTMENT AND A COOLING COMPARTMENT

(75) Inventors: Yong-woon Han, Kunpo; Han-seong Yoo, Yongin; Han-sung Kang, Suwon, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/725,902

(22) Filed: Nov. 30, 2000

(30) Foreign Application Priority Data

Sep. 15, 2000 (KR) ..... 00-54327

(51) Int. Cl.[7] ..... H05B 6/80; F25B 29/00

(52) U.S. Cl. ..... 219/681; 219/679; 219/757; 126/21 A; 165/201; 165/61; 312/236; 99/357; 62/238.3

(58) Field of Search ..... 219/679, 681, 219/680, 756, 757; 126/21 A; 165/201, 61, 58, 64, 65, 66; 312/236; 62/190, 238.1, 238.3; 99/357, 484

(56) References Cited

U.S. PATENT DOCUMENTS 4,355,521 * 10/1982 Tsai ..... 62/196 B
4,866,572 * 9/1989 Blodgett ..... 219/387
4,884,626 * 12/1989 Filipowski ..... 165/63
5,315,084 * 5/1994 Jensen ..... 219/689

FOREIGN PATENT DOCUMENTS 57-210278 * 12/1982 (JP) .
2-171505 * 7/1990 (JP) .
9-210548 * 8/1997 (JP) .
11-14067 * 1/1999 (JP) .

* cited by examiner

*Primary Examiner*—Philip H. Leung
(74) *Attorney, Agent, or Firm*—Robert E. Bushnell, Esq.

(57) ABSTRACT

A microwave oven comprises a magnetron; a body casing having a cooking compartment receiving microwaves from the magnetron and a cooling compartment formed adjacent to the cooking compartment; a thermoelement installed between the cooking compartment and the cooling compartment, and having a radiator and a heat absorber; a hot air transmitting unit transmitting hot air generated from the radiator of the thermoelement to the cooking compartment; and a cool air transmitting unit transmitting cool air generated from the heat absorber of the thermoelement to the cooling compartment. With this configuration, the cooking compartment can be used as a warmer. Also, the cooling compartment can be used as a cooler.

16 Claims, 3 Drawing Sheets

MICROWAVE OVEN WITH A COOKING COMPARTMENT AND A COOLING COMPARTMENT

This application makes reference to, incorporates the same herein, and claims all benefits accruing under 35 U.S.C. §119 from my application MICROWAVE OVEN filed with the Korean Industrial Property Office on Sep. 15, 2000 and there duly assigned Ser. No. 54327/2000.

BACKGROUND OF THE INVENTION

1. Field of the Invention

The present invention relates in general to microwave ovens, and more particularly, to a microwave oven further having the function of warming and cooling food therein.

2. Description of Related Art

Conventionally, a microwave oven heats and cooks food in a cooking compartment, using microwaves generated by a magnetron. In the microwave oven, the cooking compartment remains vacant while the magnetron is not generated.

Japanese First Publication or "Laid-Open" Number 1990-171505 discloses a microwave oven wherein a cooking compartment can serve as a cooling compartment while the microwave oven does not perform cooking or thawing. In the disclosed invention, the microwave oven is provided with a cooling device comprised of a compressor, a heat exchanger and a cooling fan. While the magnetron is not in operation, the cooking device may be operated to use the cooking compartment as the cooling compartment.

However, the conventional microwave oven having this kind of cooling device requires a space for installing the compressor, the heat exchanger and the cooling fan, and therefore, the entire volume of the microwave oven is inevitably increased. In addition, noises are generated from the compressor while the cooling operation is being operated.

SUMMARY OF THE INVENTION

Therefore, the present invention has been made in view of the above shortcomings, and it is an object of the present invention to provide a microwave oven wherein a cooking compartment can be further used as a warming compartment, and further having a cooling compartment to be used as a cooler.

This and other objects of the present invention may be achieved by a provision of a microwave oven, comprising a magnetron; a body casing having a cooking compartment is receiving microwaves from the magnetron and a cooling compartment formed adjacent to the cooking compartment; a thermoelement installed between the cooking compartment and the cooling compartment, and having a radiator and a heat absorber; a hot air transmitting unit transmitting hot air generated from the radiator of the thermoelement to the cooking compartment; and a cool air transmitting unit transmitting cool air generated from the heat absorber of the thermoelement to the cooling compartment.

The hot air transmitting unit includes a hot air inlet port formed at a first position on an inner wall of the cooking compartment, for guiding the hot air from the radiator of the thermoelement into the cooking chamber.

The hot air transmitting unit further includes a hot air outlet port formed at a second position on the inner wall of the cooking compartment for discharging the hot air, and a hot air passage for transmitting the discharged hot air toward the radiator of the thermoelement.

Preferably, the hot air transmitting unit further includes a hot air blowing fan for blowing the hot air into the cooking compartment through the hot air inlet port.

More preferably, the microwave oven further comprises a hot air exhausting hole formed on an outer wall of the body casing for discharging the hot air outside, and a hot air exhausting passage for communicating the hot air exhausting hole with the hot air passage.

Still preferably, the microwave oven further comprises a hot air damper for closing the hot air exhausting passage or the hot air inlet port.

The cool air transmitting unit includes a cool air inlet port formed on a first position of an inner wall of the cooling compartment for guiding the cool air from the heat absorber of the thermoelement into the cooling compartment.

Preferably, the cool air transmitting unit further includes a cool air outlet port formed at a second position on the inner wall of the cooling compartment for discharging the cool air from the cooling compartment, and a cool air passage for transmitting the discharged cool air toward the heat absorber of the thermoelement.

The microwave oven further comprises a cool air blowing fan for blowing the cool air into the cooling compartment through the cool air inlet port.

Preferably, the microwave oven further comprises a cool air exhausting hole formed at an outer wall of the body casing for discharging the cool air outside, and a cool air exhausting passage communicating the cool air exhausting hole with the cool air passage.

Effectively, the microwave oven further comprises a cool air damper for closing the cool air exhausting passage or the cool air inlet port.

More effectively, the radiation of the thermoelement includes a plurality of radiating fins, and the heat absorber of the thermoelement includes a plurality of cooling fins.

Preferably, an insulating material is disposed inside the inner wall of the body casing.

The microwave oven further comprises a control panel for selecting the function of operating the thermoelement, and selecting at least one of a warming function or a cooling function, and a controlling unit for controlling the operation of the thermoelement, and controlling the hot air damper so that the hot air damper closes the hot air inlet port when the warming function is off.

The microwave oven further comprises a control panel for selecting the function of operating the thermoelement, and selecting at least one of a warming function or a cooling function, and a controlling unit for controlling the operation of the thermoelement, and controlling the cool air damper so that the cool air damper closes the cool air inlet port when the cooling function is off.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF PREFERRED EMBODIMENTS

Figure 1:
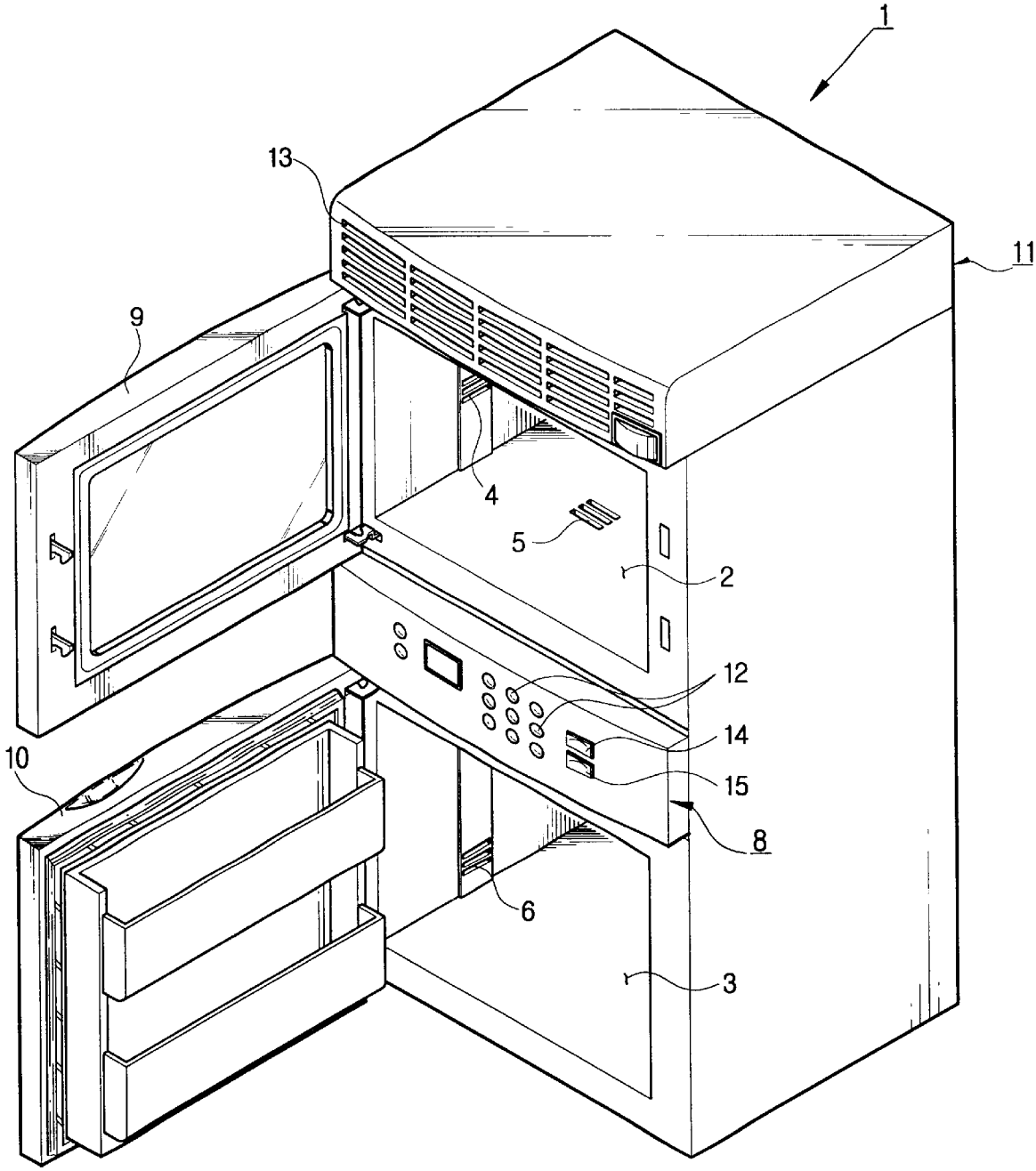
FIG. 1 is a perspective view of a microwave oven according to the present invention.
Figure 2:
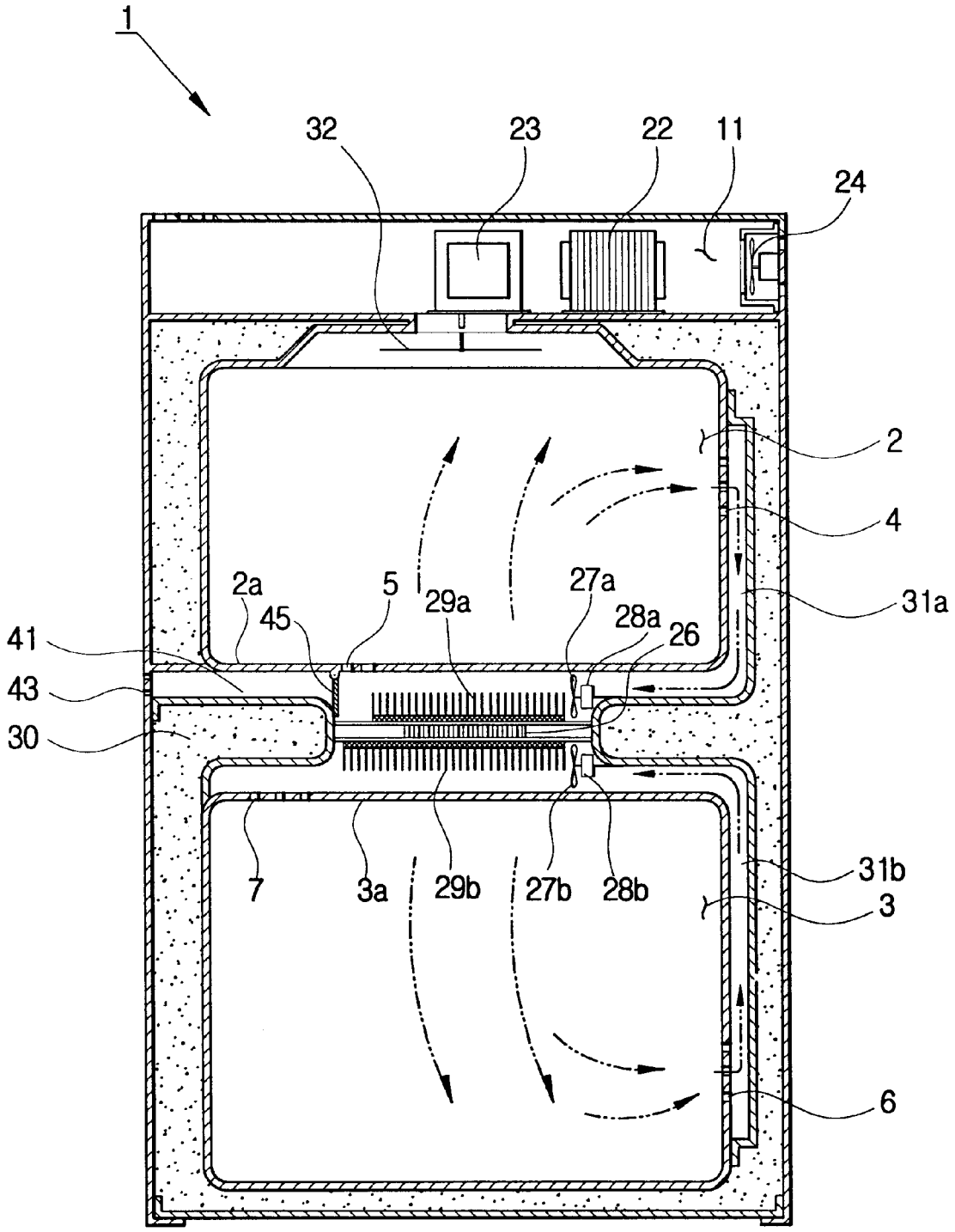
FIG. 2 is an elevational sectional view of the microwave oven of FIG. 1.

Referring to FIGS. 1 and 2, the microwave oven is comprised of a body casing divided into a cooking compartment 2 and a cooling compartment 3, and doors 9 and 10 respectively opening and closing the cooking compartment 2 and the cooling compartment 3.

In an inner top part of the cooking compartment 2 is provided a stirrer 32 dispersing microwaves generated by a magnetron 23 into the cooking compartment 2 while the magnetron 23 is being in operation. Over the cooking compartment 2 is provided a component chamber 11 wherein the magnetron 23, a high-voltage transformer 22 driving the magnetron 23, and a cooling fan 24 are installed. In the upper front of the component chamber 11 are formed a plurality of discharge ports 13 through which hot air generated in the component chamber 11 is discharged out.

Between the cooking compartment 2 and the cooling compartment 3 is externally installed a control panel 8 for operating the microwave oven. The control panel 8 is comprised of a plurality of cooking selection buttons 12, a cooling selection button 14 for activating the cooling compartment 3 and a warming selection button 15 for activating the cooking compartment as a warming compartment. The cooling and warming functions are performed by a thermoelement 26 (see FIG. 2). The cooling and warming functions can be respectively selected and cancelled by pressing the cooling selection button 14 and the warming selection button 15. Between the inner and outer walls of the body casing 1 is provided an insulating member 30. In a space formed between a bottom 2*a* of the cooking compartment 2 and a ceiling 3*a* of the cooling compartment 3 is installed the thermoelement 26 having a radiator and a heat absorber. The radiator and the heat absorber are comprised of a plurality of radiating fins 29*a* and a plurality of heat absorbing fins 29*b*, respectively. The body casing 1 is provided with a hot air transmitting unit for transmitting hot air from the radiator 29*a* of the thermoelement 26 into the cooking compartment 2, and a cool air transmitting unit for transmitting cool air from the heat absorber 29*b* of the thermoelement 26 into the cooling compartment 3.

The hot air transmitting unit is comprised of a plurality of hot air inlet ports 5 formed at the bottom 2*a* of the cooking compartment 2 for guiding hot air from the radiator 29*a* of the thermoelement 26 into the cooking compartment 2, a plurality of hot air outlet ports 4 formed at a side wall of the cooking compartment 2 for discharging the hot air from the cooking compartment 2, and has a hot air passage 3*a* extending from the inside of the side wall of the cooking compartment 2 to the space in which the thermoelement 26 is installed, for guiding the hot air from the hot air outlet ports 4 toward the thermoelement 26. In the hot air passage 31*a* adjacent to the radiating fins 29*a* of the thermoelement 26 are provided a hot air blowing fan 27*a* forcibly supplying the hot air generated from the radiating fins 29*a* into the cooking compartment 2, and a driving motor 28*a* driving the hot air blowing fan 27*a*.

An exhaust port 43 is provided at an outer wall surface of the body casing 1, and a hot air exhausting passage 41 is formed between the exhaust port 43 and the hot air passage 31*a*. At the inlet of the hot air exhausting passage 41 are provided a damper 45 and a motor 36 (see FIG. 3) for driving the damper 45. The damper 45 selectively closes one of the hot air inlet ports 5 and the hot air exhaust passage 41.

The cool air transmitting unit is comprised of a plurality of cool air inlet ports 7 formed at the ceiling 3*a* of the cooling compartment 3 for guiding cool air from the heat absorbing fins 29*b* of the thermoelement 26 into the cooling compartment 8, a plurality of cool air outlet ports 6 formed at a side wall of the cooling compartment 3 for discharging the cool air from the cooling compartment 3, and a cool air passage 31*b* extending from the inside of the side wall of the cooling compartment 3 to the space in which the thermoelement 26 is installed, for guiding the cool air from the cool air outlet ports 6 toward the thermoelement 26. In the cool air passage 31*b* adjacent to the heat absorbing fins 29*b* of the thermoelement 26 are provided a cool air blowing fan 27*b* forcibly supplying the cool air generated by the cooling fins 29*b* to the cooling compartment 3, and a driving motor 28*b* driving the cool air blowing fan 27*b*.

Figure 3:
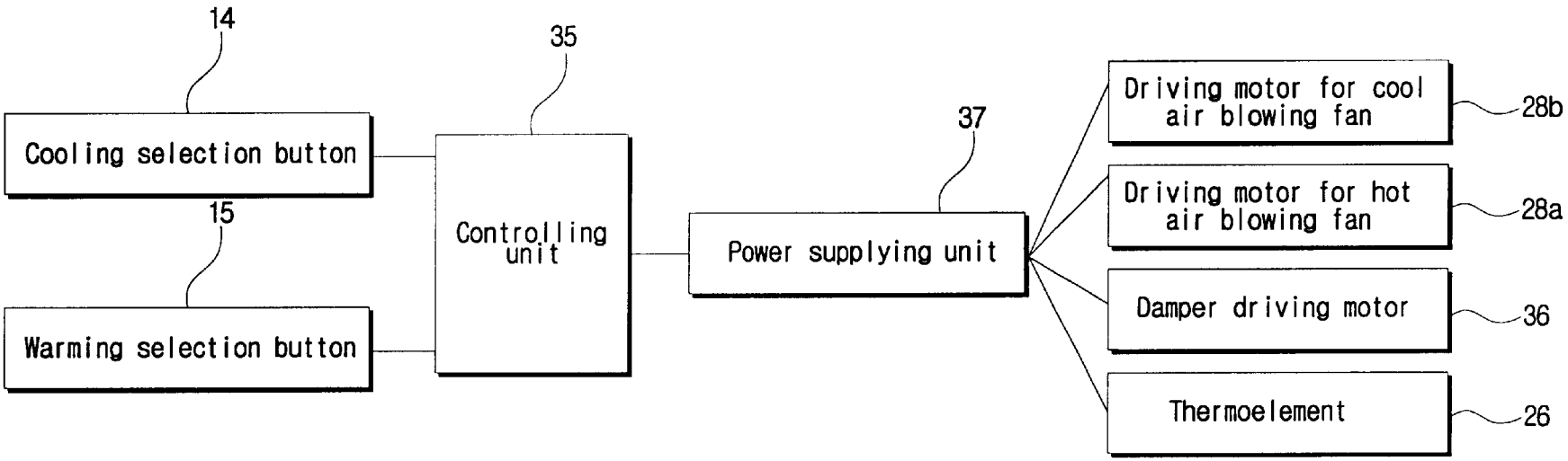
FIG. 3 is a block diagram of a controlling unit in the microwave oven according to the present invention.

Hereinafter, a controlling operation of the microwave oven will de described in detail, referring to FIG. 3 which is a block diagram of the microwave oven according to the present invention.

As depicted therein, the microwave oven according to the present invention is comprised of the cooling selection button 14, the warming selection button 15, the thermoelement 26, the motors 28*a* and 28*b* for driving the blowing fans 27*a* and 27*b*, the motor 36 for driving the damper 45, and a power supplying unit 37 supplying an electric power to the respective components. The microwave oven is provided with a controlling unit 35 for controlling the power supplying unit 37 to drive the driving motor 28*b* for the cool air blowing fan 27*b* where any one of the cooling selection buttons 14 is selected, and to drive the driving motor 28*a* for the hot air blowing fan 27*a* and the damper driving motor 36 where the warming selection button 15 is selected.

The controlling unit 35 controls the power supplying unit 37 to determine whether to supply an electric power into the thermoelement 26, depending upon on or off selection of the cooling selection button 14 or the warming selection button 15.

With this configuration, when the cooling selection button 14 provided in the control panel 8 is pushed on, an electric power is supplied into the thermoelement 26, cool air is then generated from the heat absorbing or cooling fins 29*b*, and the generated cool air is supplied into the cooling compartment 3. While the warming function is not selected, the controlling unit 35 activates the damper driving motor 36 for the damper 45 to close the hot air inlet ports 5 of the cooking compartment 2.

When the warming selection button 15 provided in the control panel 8 is pushed on, an electric power is supplied into the thermoelement 26, hot air is then generated from the radiating fins 29*a*, and the controlling unit 35 activates the damper driving motor 36 for the damper 45 to close the exhausting passage 41. The hot air generated from the radiating fins 29*a* is supplied into the cooking compartment 3 through the hot air inlet ports 5, and then circulates via the hot air outlet ports 4 and the hot air passage 31*a*, thereby performing the warming function.

Where the cooling selection button 14 and the warming selection button 15 turn on simultaneously, the controlling unit 35 supplies an electric power to the thermoelement 26, moves the damper 45 to close the exhausting passage 41, and activates the hot air blowing fan 27*a* and the cool air blowing fan 27*b* at the same time, to thereby perform the warming and cooling functions.

In the present embodiment, the cooling compartment of the microwave oven is positioned over the cooling compartment. However, the cooking compartment may be positioned below the cooling compartment or the cooling compartment and the cooling compartment may be horizontally disposed in parallel.

In the present embodiment, the microwave oven employing the mechanism of the stirrer is described. However, the present invention can be applied to a microwave oven employing a turntable rotating a tray on which food is put.

In the present embodiment, the damper, the damper driving motor and the external exhaust port are positioned at the side of the hot air transmitting unit. However, the damper, the damper driving motor and the external exhaust port can be positioned at the side of the cool air transmitting unit. Additionally, pairs of dampers, damper driving motors and external exhaust ports can be installed at the sides of the cool air transmitting unit and the hot air transmitting unit, respectively.

According to the present embodiment, the cooling selection button and the warming selection button are installed in the controlling unit. However, a temperature selection button for adjusting the amount of current to be supplied into the thermoelement and the driving motor may be further provided, to select at least one of a cooling temperature or a warming temperature.

As described above, in the microwave oven according to the present invention, the cooking compartment can be used as a warming compartment. By further providing a cooling compartment, in addition to the cooking compartment, the cooling compartment in the microwave oven can be used as a cooler.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising: a magnetron;

a body casing having a cooking compartment receiving microwaves from the magnetron and a cooling compartment formed adjacent to the cooking compartment;

a thermoelement installed between the cooling compartment and the cooling compartment, and having a radiator and a heat absorber;

a hot air transmitting unit transmitting hot air generated from the radiator of the thermoelement to the cooking compartment; and a cool air transmitting unit transmitting cool air generated from the heat absorber of the thermoelement to the cooling compartment.

2. The microwave oven according to claim 1, wherein the hot air transmitting unit includes a hot air inlet port formed at a first position on an inner wall of the cooking compartment, for guiding the hot air from the radiator of the thermoelement into the cooking chamber.

3. The microwave oven according to claim 2, wherein the hot air transmitting unit further includes a hot air outlet port formed at a second position on the inner wall of the cooking compartment for discharging the hot air, and a hot air passage for transmitting the discharged hot air toward the radiator of the thermoelement.

4. The microwave oven according to claim 3, wherein the hot air transmitting unit further includes a hot air blowing fan for blowing the hot air into the cooking compartment through the hot air inlet port.

5. The microwave oven according to claim 4, further comprising a hot air exhausting hole formed on an outer wall of the body casing for discharging the hot air outside, and a hot air exhausting passage for communicating the hot air exhausting hole with the hot air passage.

6. The microwave oven according to claim 5, further comprising a hot air damper for closing the hot air exhausting passage or the hot air inlet port.

7. The microwave oven according to claim 6, further comprising a control panel for selecting the function of operating the thermoelement, and selecting at least one of a warming function or a cooling function, and a controlling unit for controlling the operation of the thermoelement, and controlling the hot air damper so that the hot air damper closes the hot air inlet port when the warming function is off.

8. The microwave oven according to claim 1, wherein the cool air transmitting unit includes a cool air inlet port formed on a first position of an inner wall of the cooling compartment for guiding the cool air from the heat absorber of the thermoelement into the cooling compartment.

9. The microwave oven according to claim 8, wherein the cool air transmitting unit further includes a cool air outlet port formed at a second position on the inner wall of the cooling compartment for discharging the cool air from the cooling compartment, and a cool air passage for transmitting the discharged cool air toward the heat absorber of the thermoelement.

10. The microwave oven according to claim 9, further comprising a cool air blowing fan for blowing the cool air into the cooling compartment through the cool air inlet port.

11. The microwave oven according to claim 10, further comprising a cool air exhausting hole formed at an outer wall of the body casing for discharging the cool air outside, and a cool air exhausting passage communicating the cool air exhausting hole with the cool air passage.

12. The microwave oven according to claim 11, further comprising a cool air damper for closing the cool air exhausting passage or the cool air inlet port.

13. The microwave oven according to claim 12, further comprising a control panel for selecting the function of operating the thermoelement, and selecting at least one of a warming function or a cooling function, and a controlling unit for controlling the operation of the thermoelement, and controlling the cool air damper so that the cool air damper closes the cool air inlet port when the cooling function is off.

14. The microwave oven according to claim 1, wherein the radiation of the thermoelement includes a plurality of radiating fins.

15. The microwave oven according to claim 1, wherein the heat absorber of the thermoelement includes a plurality of cooling fins.

16. The microwave oven according to claim 1, wherein an insulating material is disposed inside the inner wall of the body casing.

* * * * *